US005791918A

United States Patent [19]

Pierce

[11] Patent Number: 5,791,918

[45] Date of Patent: Aug. 11, 1998

[54] SPARK PLUG CONNECTOR

[76] Inventor: William E. Pierce, Rt. 1, Box 1656, Ochelata, Okla. 74051

[21] Appl. No.: 823,131

[22] Filed: Mar. 25, 1997

[51] Int. Cl.[6] ..... H01R 13/44

[52] U.S. Cl. ..... 439/127; 439/818; 439/814

[58] Field of Search ..... 439/127, 817, 439/819, 729, 789, 814, 818

[56] References Cited

U.S. PATENT DOCUMENTS

| | | | |
|---|---|---|---|
| 266,287 | 10/1882 | Haskins et al. | 439/818 |
| 1,547,314 | 7/1925 | Frankel | 439/822 |
| 2,153,176 | 4/1939 | Douglas | 439/818 |
| 2,375,656 | 5/1945 | Jackson | 173/363 |
| 2,533,763 | 12/1950 | Cacciotti | 439/818 |
| 2,846,658 | 8/1958 | Bender | 439/891 |
| 3,321,736 | 5/1967 | Flynn | 439/822 |
| 3,737,832 | 6/1973 | Anderson | 439/822 |
| 3,828,297 | 8/1974 | Hoza, III | 439/105 |
| 4,815,991 | 3/1989 | Bakke | 439/502 |
| 5,127,840 | 7/1992 | Bezusko et al. | 439/127 |
| 5,209,679 | 5/1993 | Quinlan | 439/822 |
| 5,421,736 | 6/1995 | Imanishi et al. | 439/127 |

*Primary Examiner*—Neil Abrams
*Assistant Examiner*—Katrina Davis
*Attorney, Agent, or Firm*—William R. Sharp

[57] ABSTRACT

There is provided a spark plug connector for connection to a spark plug having an elongated terminal with a grooved portion, comprising: a body having a longitudinal axis and an internal bore extending along the axis; a means for fixedly positioning a wire within the body closely adjacent to the bore; a locking member reciprocably mounted to the body so as to be selectively movable between a first position and a second position, wherein in the first position the terminal can be inserted into the bore to contact the wire and in the second position the locking member engages the grooved portion of the terminal to lock the terminal in position with respect to the wire and body.

8 Claims, 2 Drawing Sheets

SPARK PLUG CONNECTOR

BACKGROUND OF THE INVENTION

This invention relates to an improved spark plug connector.

A spark plug connector connects a wire to the terminal of the spark plug. The standard spark plug connector provides unsteady and sometimes poor contact between the wire and the terminal. This can lead to poor performance of the engine.

SUMMARY OF THE INVENTION

It is, therefore, an object of the invention to provide a spark plug connector that positively locks the connector to the spark plug so as to provide good and reliable contact between the wire and the terminal.

The above object is realized by a spark plug connector for connection to a spark plug having an elongated terminal with a grooved portion, comprising: a body having a longitudinal axis and an internal bore extending along the axis; a means for fixedly positioning a wire within the body closely adjacent to the bore; a locking member reciprocally mounted to the body so as to be selectively movable between a first position and a second position, wherein in the first position the terminal can be inserted into the bore to contact the wire and in the second position the locking member engages the grooved portion of the terminal to lock the terminal in position with respect to the wire and body.

DETAILED DESCRIPTION OF THE INVENTION

Figure 1:
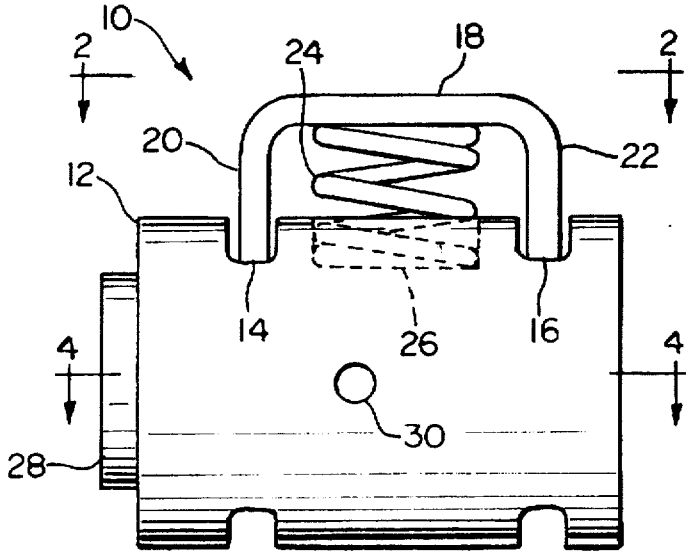
FIG. 1 is a side view of a spark plug connector in accordance with the invention.

Referring to FIG. 1, the illustrated spark plug connector 10 comprises a substantially cylindrical body 12 having transverse slots 14 and 16, a locking member 18 reciprocally mounted to body 12 and shown in its locked position with legs 20 and 22 received in slots 14 and 16, respectively, a spring 24 having one end received in a recess 26 in body 12 and the other end in contact with locking member 18 so as to bias locking member 18 toward the locked position, and a screw 28 of which only the head is visible in FIG. 1. Body 12 further has a transversely extending hole 30 for receiving a wire therethrough.

Figure 2:
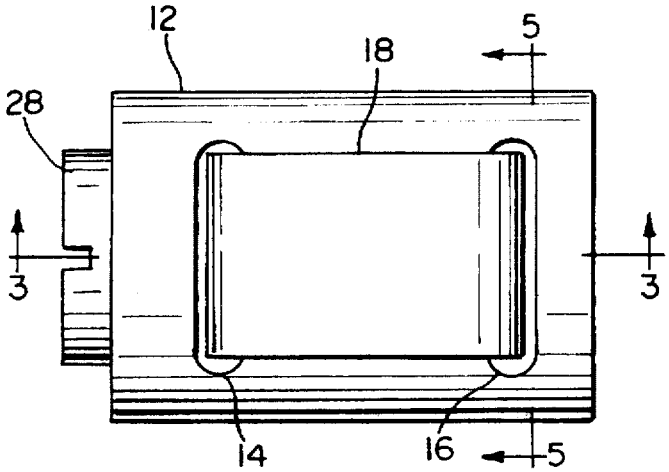
FIG. 2 is a view of the spark plug connector as viewed along line 2—2 in FIG. 1.

Referring to FIG. 2, a different view of spark connector 10 is shown in which the manner in which slots 14 and 16 transversely extend across body 12 is apparent.

Figure 3:
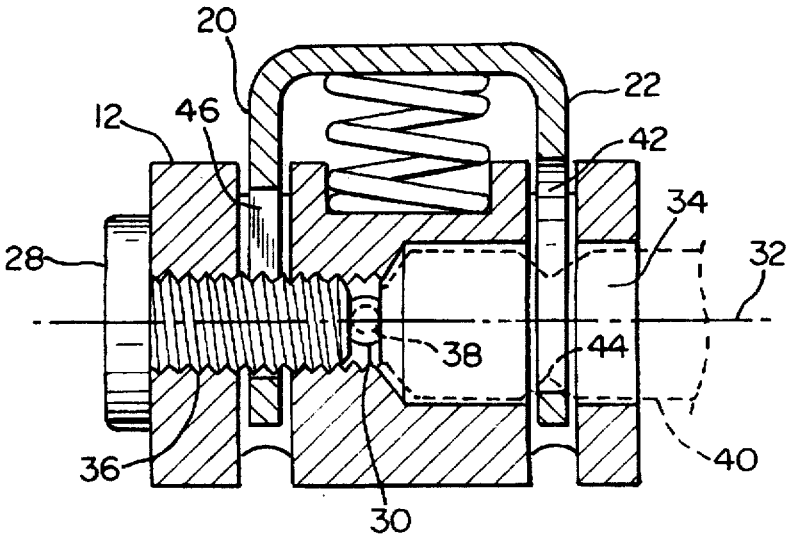
FIG. 3 is a cross-sectional view of the spark plug connector as viewed along line 3—3 in FIG. 2.

Referring to FIG. 3, body 12 is shown as having a longitudinal axis 32 along which an internal bore 34 extends. A threaded internal bore 36 is substantially coaxial with bore 34 and receives the threaded portion of screw 28 therein. Hole 30 intersects bore 36 so as to be closely adjacent to the end of bore 34. The position of a wire extending through hole 30 is shown by a broken line at 38 as being in snug contact with the end of screw 28 to thereby assist in fixedly positioning the wire within body 12. The position of an elongated spark plug terminal within bore 34 is shown by a broken line at 40 as being in contact with wire 38 and as extending through an aperture 42 in leg 22 so that leg 22 engages a grooved portion 44 of terminal 40 to lock the terminal in position with respect to wire 38 and body 12. Leg 20 also has an aperture 46 through which screw 28 extends.

Figure 4:
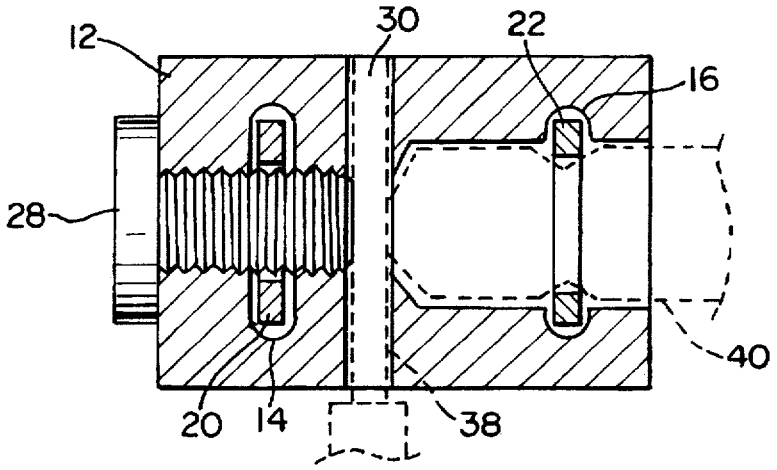
FIG. 4 is a cross-sectional view of the spark plug connector as viewed along line 4—4 in FIG. 1.

Referring to FIG. 4, this FIGURE more clearly shows the transversely extending hole 30 and the position of wire 38 therein. It can also be clearly seen that screw 28 and terminal 40 are in contact with wire 38.

Figure 5:
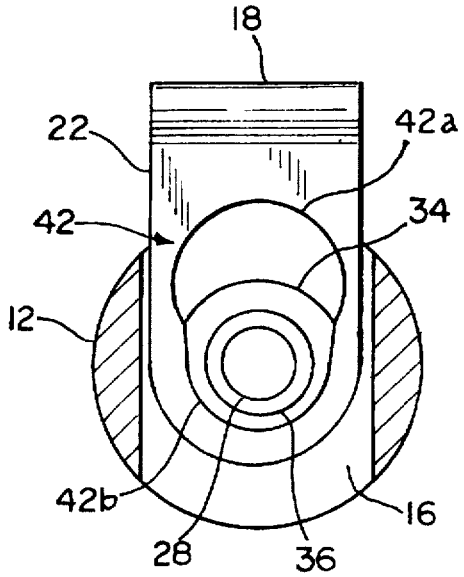
FIG. 5 is a cross-sectional view of the spark plug connector as viewed along line 5—5 in FIG. 2, wherein the connector is in its locked position.

Referring to FIG. 5, with the locking member 18 in the locked position, aperture 42 is shown as having a first portion **42*a* and a second portion 42*b*. Portion 42*b* is of a size enabling locking member 18 and its leg 22** to snugly engage the grooved portion of a spark plug terminal.

Figure 6:
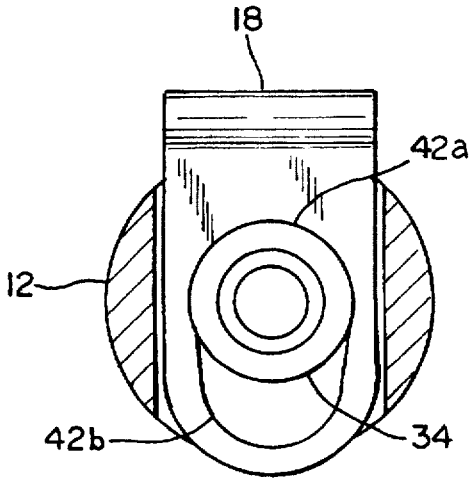
FIG. 6 is a cross-sectional view similar to FIG. 5 except that the connector is in its open position for insertion or removal of a spark plug into or from the connector.

Referring to FIG. 6, locking member 18 is shown as being in the open position. This is achieved by simply holding body 12 and pushing down upon locking member 18. In this position, portion **42*a* coincides with a portion of bore 34 and allows the terminal of a spark plug to be inserted into bore 34 to contact a wire within body 12. To lock the terminal in position, locking member 18 is simply released and the spring (FIGS. 1 and 3) biases locking member 18 to the locked position. To withdraw the terminal from bore 34, locking member 18 is again pushed down to the open position and the locking member is withdrawn through portion 42*a* and from bore 34**.

With respect to materials of construction, body 12 is preferably copper, locking member 18 is preferably stainless steel, spring 24 is preferably carbon steel, and screw 28 is preferably cadmium coated carbon steel.

Spark plug connector 10 can, if desired, be encased in an elastomeric boot (not shown).

Obviously, many modifications and variations of the present invention are possible in light of the above teachings. It is, therefore, to be understood that within the scope of the appended claims, the invention may be practiced otherwise than as specifically described.

That which is claimed is:

1. A spark plug connector for connection to a spark plug having an elongated terminal with a grooved portion, comprising:

a body having a longitudinal axis and an internal bore extending along the axis;

a means for fixedly positioning a wire within the body closely adjacent to the bore;

a locking member reciprocally mounted to the body so as to be selectively movable between a first position and a second position, wherein in the first position the terminal can be inserted into the bore to contact the wire and in the second position the locking member engages the grooved portion of the terminal to lock the terminal in position with respect to the wire and body.

2. A spark plug connector as recited in claim 1 further comprising a biasing means for biasing the locking member toward the second position.

3. A spark plug connector as recited in claim 2 wherein the biasing means comprises a spring.

4. A spark plug connector as recited in claim 3 wherein the locking member has a leg having an aperture with a first portion of a size sufficient to receive the terminal therethrough in the first position and a second portion of a size enabling the locking member to snugly engage the grooved portion of the terminal in the second position.

5. A spark plug connector as recited in claim 4 wherein the internal bore is a first bore and the body has a threaded second bore substantially coaxial with the first bore, and wherein the body has a transversely extending hole, intersecting the second bore and closely adjacent to the first bore, for receiving the wire therethrough, and further wherein the spark plug connector comprises an elongated threaded member received in the second bore and having an end positioned to be in snug contact with the wire to thereby assist in fixedly positioning the wire within the body.

6. A spark plug connector as recited in claim 5 wherein the threaded member comprises a screw.

7. A spark plug connector as recited in claim 6 wherein the leg is a first leg and wherein the locking member further has a second leg having an aperture through which the screw extends.

8. A spark plug connector as recited in claim 7 wherein the body has a first slot for receiving the first leg and a second slot for receiving the second leg.

* * * * *